US010107543B2

(12) United States Patent
Pourrahimi et al.

(10) Patent No.: US 10,107,543 B2
(45) Date of Patent: Oct. 23, 2018

(54) CRYOGENIC THERMAL STORAGE

(71) Applicants: Shahin Pourrahimi, Brookline, MA (US); Leslie Bromberg, Sharon, MA (US)

(72) Inventors: Shahin Pourrahimi, Brookline, MA (US); Leslie Bromberg, Sharon, MA (US)

( * ) Notice: Subject to any disclaimer, the term of this patent is extended or adjusted under 35 U.S.C. 154(b) by 435 days.

(21) Appl. No.: 14/086,847

(22) Filed: Nov. 21, 2013

(65) Prior Publication Data

US 2015/0135732 A1 May 21, 2015

(51) Int. Cl.

| | |
|---|---|
| ***H01F 6/04*** | (2006.01) |
| ***F25D 17/02*** | (2006.01) |
| ***F25D 19/00*** | (2006.01) |

(52) U.S. Cl.

CPC ..... *F25D 17/02* (2013.01); *F25D 19/006* (2013.01); *H01F 6/04* (2013.01); *F25B 2400/06* (2013.01); *F25B 2400/24* (2013.01)

(58) Field of Classification Search

CPC .... F25D 17/02; F25D 19/006; F25B 2400/24; F25B 2400/06; H01F 6/04

USPC ..... 62/6, 437; 165/10

See application file for complete search history.

(56) References Cited

U.S. PATENT DOCUMENTS

| | | | | | |
|---|---|---|---|---|---|
| 4,796,433 | A * | 1/1989 | Bartlett | H01F 6/04 | 62/47.1 |
| 4,807,696 | A * | 2/1989 | Colvin | F28D 20/023 | 126/400 |
| 2005/0086974 | A1* | 4/2005 | Steinbach | F25B 9/14 | 62/437 |
| 2007/0044484 | A1* | 3/2007 | Gedeon | F25B 9/145 | 62/6 |
| 2010/0252232 | A1* | 10/2010 | Reich | F28D 20/0034 | 165/48.1 |
| 2012/0319410 | A1* | 12/2012 | Ambrosek | F02C 1/05 | 290/1 R |

* cited by examiner

*Primary Examiner* — Ana M Vazquez
(74) *Attorney, Agent, or Firm* — Arjomad Law Group, PLLC

(57) ABSTRACT

A method, a system, and an article of manufacture are disclosed for cryogenic cooling of systems operating at cryogenic temperatures or higher. Applications of this disclosure are as varied as trucking of meat and vegetable to mine sweeping and MRI systems. A cooling network is formed by coupling blocks of Thermal Energy Storage (TES) modules together with optional thermal switches or valves and optionally with an active cooling component to maintain a cryogenic temperature in a cryostat. The TES modules are combinations of thermal conducting elements to conduct heat and solid storage elements to absorb heat. The cooling component may be one or more cryocoolers for steady state and transient heat transfer conditions and may be coupled with the TES modules via thermal shunt connections. The thermal switches or valves may be deployed within the thermal shunts to control the flow of heat between different TES modules and cooling components, thus reconfiguring the cooling network.

20 Claims, 4 Drawing Sheets

CRYOGENIC THERMAL STORAGE

CROSS-REFERENCE(S) TO RELATED APPLICATION(S)

This application claims the benefit of the filing date of the U.S. Provisional Patent Application 61/729,118, entitled "CRYOGENIC THERMAL STORAGE," filed on 21 Nov. 2012, under 35 U.S.C. § 119(e).

TECHNICAL FIELD

This application relates generally to cooling and refrigeration systems. More specifically, this application relates to the design, manufacture, and use of solid modules of composite materials suitable for thermal storage at cryogenic temperatures.

BRIEF DESCRIPTION OF THE DRAWINGS

The drawings, when considered in connection with the following description, are presented for the purpose of facilitating an understanding of the subject matter sought to be protected.

FIG. 2A shows a foam with conductive fibers. FIG. 2B shows the foam block of FIG. 2A partially covered with a polymer encapsulant that is provided for heat absorption;

DETAILED DESCRIPTION

Figure 1:
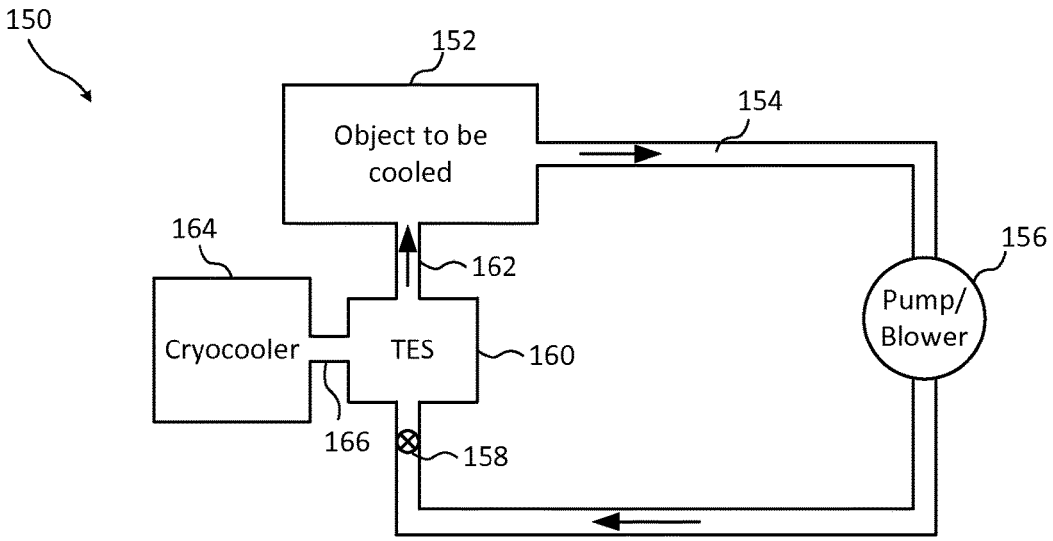
FIG. 1 shows an example cryogenic cooling system.

While the present disclosure is described with reference to several illustrative embodiments described herein, it should be clear that the present disclosure should not be limited to such embodiments. Therefore, the description of the embodiments provided herein is illustrative of the present disclosure and should not limit the scope of the disclosure as claimed. In addition, while the following description references application of a cooling block having polymer components for heat absorption, those skilled in the art will appreciate that other solid material may be used for heat absorption such as silicone based material, and the like.

Briefly described, a method and a system are disclosed for cryogenic cooling of systems operating at cryogenic temperatures or higher. In various embodiments, a cooling network is formed by coupling blocks of Thermal Energy Storage (TES) modules together with options of thermal switches or valves and optionally with cryocoolers to maintain a desired cryogenic temperature range in a cryostat (cryogenic vessel/container). In some embodiments, the TES modules are created using thermal storage blocks. The thermal storage block may be made of a combination of thermal conducting elements to conduct heat and solid storage elements to absorb heat. In various embodiments, the cryocoolers may be of different sizes to accommodate steady state and transient heat transfer conditions. The cryocoolers may be coupled with the TES modules via thermal shunt connections. In various embodiments, thermal valves or switches may be deployed within the thermal shunts to control the flow of heat and/or reroute heat flow between different TES modules and cryocoolers, thus reconfiguring the cooling network. In various embodiments, different thermal storage blocks may be employed each with different characteristics, structure, configuration, material, composition, heat capacity, and other similar characteristics.

There are many diverse applications for a reliable, cost-effective, weight-effective, and high thermal capacity cooling system, which may be active or passive. An active system uses an active cooling apparatus which uses energy, such as electricity, to remove heat in a refrigeration cycle. A passive system is pre-cooled and uses its thermal capacity to keep an area or a device cool for a period of time determined by the thermal capacity of the passive cooling system. A large thermal capacity extends the time period a passive thermal storage system can effectively function without being connected to an active cooling system. The applications for these cooling systems range from cooling MRI superconducting magnets to food refrigeration. Some examples include mine sweeping navy boats with superconducting magnets that need to be kept at cryogenic temperatures. Thermal storage modules described below may be cooled onshore to cryogenic temperatures and be carried offshore on the mine sweeping boats. Other examples are refrigerated trucks with thermal storage components built into their walls, natural gas liquefaction, and generally any refrigeration or cooling application that needs a cooling source.

One of the many diverse uses of cryogenic cooling systems is in superconducting devices. Superconducting components of a superconducting device, such as wires and other conductors are operated at very low cryogenic temperature near 0 Kelvin (K) or a few degrees above absolute zero temperature. At such low temperatures, the superconducting components have zero or near zero electrical resistance. Those skilled in the art know that electrical resistance dissipates energy through heat. Therefore, if the resistance is zero (or near zero) energy dissipation is zero or near zero depending on operating conditions. Hence, the use of superconducting components is desirable and efficient in some applications.

Cryogenic devices, such as superconducting magnets, superconducting electrical transmission or distribution systems, or other electrical superconducting cables, are cooled to their operating temperatures and maintained at their operating temperatures by a cooling system. Many cooling systems use one or a combination of: a) liquid cryogens, b) gaseous cryogens, or c) one or more cryogenic cooling systems, or cryocoolers. The liquid and gaseous cryogens may be flowing or not flowing over or through the cryogenic device that is to be kept cool. Cryocoolers may be in contact with either the device or the cryogens. In some applications cryocoolers make directed mechanical contact with the items to be cooled and therefore are called conduction cooled devices. During operation of the device, the cooling systems work to remove the heat that transfers to the device from the ambient surrounding, as well as, the heat that may be generated by the device itself.

Often a cryogenic device is designed and manufactured so that it can safely operate over a certain temperature range, such as (1) a temperature range of 1 K-10 K, for devices like superconducting magnets that use Nb—Ti superconductors, (2) a temperature range of 1K-16K, for devices like superconducting magnets that use $Nb_3Sn$ superconductor magnets, (3) a temperature range of 4K-25K for devices like superconducting magnets that use $MgB_2$ superconductor magnets, and (4) a temperature range of 4K-80K for devices like superconducting magnets that use HTS (High Temperature Superconducting) type superconductor magnets. When the cooling system of devices such as (1)-(4) above malfunctions, heat removal slows, or ceases, and the device starts to absorb heat. Heat absorption by the device leads to gradual temperature rise of the device for as long as the operation of the cooling system is not restored. The heat capacity of the cryogenic device determines how long the device can stay in operation with the cooling system not working. Often the heat capacity of most of the materials that are used to build a cryogenic device are not particularly high. There is a need to increase the heat capacity of cryogenic devices by utilizing materials that have a relatively high ratio of heat capacity over mass density. This is needed so that an increase in heat capacity of the cryogenic device does not lead to a high mass and volume of the overall cryogenic device.

It is also desirable that heat can be transferred to or removed from a cryogenic thermal storage device to minimize or reduce thermal gradients (temperature differences between different points) within the cryogenic thermal storage device, when it is actively cooling the cryogenic device. Finally, in the case of flowing gaseous cryogens, good heat transfer between the gas and the cryogenic storage material is desired.

An example of such cryogenic devices/systems and applications is Magnetic Resonance Imaging (MRI.) MRI is a technique for accurate and high-resolution visualization of interior of animal tissues. Imaging by an MRI scanner requires a very uniform, constant, and stable magnetic field over a specific volume. Conventionally, such a magnetic field, is produced by a permanent or a superconducting magnet that need to be maintained at cryogenic temperatures that are lower than the critical temperature of the superconducting coils to allow superconductor mode of the coil material to appear, in which electrical resistance is zero. To achieve this, conventionally, the coils of a superconducting MRI magnet operate in a pool of liquid helium, at close to atmospheric pressure that keeps the coils at about 4.2 K. An alternative to operating MRI superconducting coils in a pool of liquid helium is to cool the coils by a cryocooler that is physically connected to the coils by solid materials that conduct heat away from the coils. Conventionally, these types of magnets are called cryogen-free (CF) or conduction cooled magnets.

In various embodiments, a passive cooling system needs to be coupled with an active cooling system on occasion as needed to remove heat from it and/or keep it at a desired temperature, in a manner similar to an ice cube that is or is kept frozen by a freezer. In various embodiments, a predetermined threshold temperature may be used to determine when the passive cooling system should be coupled with the active cooling system to cool down. As the passive cooling system warms up by absorbing more heat, its temperature rises. When the temperature of the passive elements reaches the predetermined threshold, then the active cooling system is coupled with it and activated to cool it down. In various embodiments, the threshold may be dynamically set depending on the needs of the application and based on various parameters such as expected cooling loads and sensitivity of the cryostat or the cryogenic device to rising temperatures.

In various embodiments, a passive cooling system may be used in applications where cryogenic temperatures are not needed, such as in food transportation or storage industries. In such applications, the high thermal capacity of the passive TES modules, further described below with respect to FIGS. 2 and 3, may be used to maintain a temperature higher than cryogenic temperatures by controlled insulation and/or isolation of the cooled space from the TES modules.

FIG. 1 shows an example cryogenic cooling system. In various embodiments, a cooling system 150 includes Cold-mass (object to be cooled) within a cryostat (cooling vessel) 152, refrigerant channel 154, pump or blower 156, flow control valve 158, Thermal Energy Storage (TES) module 160 coupled with cryocooler 164 via thermal shunt 166, and refrigerant channel 162 coupled with TES module 160 and cryostat 152.

In various embodiments, the cooling system 150 may have one or more of the components shown. For example, the cooling system 150 may include multiple TES modules, multiple cryocoolers, and/or multiple pump/blower components. In other embodiments, the cooling system may have fewer than all of the components shown. For example, in some cooling system the pump/blower 156 may be absent.

In operation, the object or device to be cooled, such as a superconducting magnet, various magnetic coils, and/or wire segments, and structural components are generally integrated to form a cold-mass within cryostat 152 and a working refrigerant fluid, such as helium gas or other liquid refrigerant, is moved through refrigerant channels 154 and 162, using a pump or blower 156 to remove and transfer heat from the cryostat to the TES module and/or the cryocooler, thus maintaining a low cryogenic temperature within the cryostat. Generally, the cold-mass within cryostat is the object or component that is intended to be cooled and may be kept at a substantially uniform temperature. The cryostat itself may have relatively more variation in its temperature. In various embodiments, the cooling system may alternate between passive and active modes. In the passive mode, the cryocooler 164 is decoupled from the TES module 160, while in active mode it is connected to the TES module to cool it down.

In addition to the passive and active modes, but related to them, two distinct heat removal operations may occur during the operation of the cooling system: one, a steady-state, relatively low energy heat transfer operation primarily used to maintain the current temperature of the cold-mass, and two, a transient, relatively high energy heat transfer operation primarily used to change the current temperature of the cryostat. In the steady-state operation, the cooling system removes the marginal heat generated by the cryogenic device within the cryostat during normal operation. In the transient operation, the cryostat temperature is actively changed to bring it into a steady operating mode, for example, after a cooling system failure, maintenance, upgrade operation and the like, during which failure the operation of the cryogenic device and/or the cooling system may cease or be partially reduced. In such transient situations, to maintain the temperature below a certain maximum or get the cold-mass temperature back down to a desirable operating level, more heat or thermal energy needs to be removed from the cryostat and transferred to the TES modules and/or the cryocooler. Once the desired temperature is reached, then the stead-state operation with lower heat transfer rates is resumed.

In the operating environment described above, using different cryocoolers with different cooling capacities may be advantageous, as further described below with respect to FIG. 7. In various embodiments, multiple cryostats, multiple TES modules, and multiple cryocoolers may be thermally and/or physically interconnected through thermal switches and valves to dynamically reconfigure the cooling system for the specific needs of the cryogenic device and/or the cooling system. For example, multiple cryostats may be coupled with one large cryocooler for transient heat transfer, while each cryostat may have its own dedicated cryocooler for steady-state operation. This way, one large cryocooler may be used for cooling multiple cryostats.

In various embodiments, the a blower may be used for gas movement through refrigerant channels if the refrigerant is a gas such as helium and a pump may be used if the refrigerant is a liquid. In some embodiments, actuator controlled valves may be used to control and/or block refrigerant movements through the ducts or cooling channels.

In various embodiments, the TES module may be made from multiple thermal storage blocks as further described below with respect to FIGS. 2 and 3.

In various embodiments, the cryocooler coupled with the TES modules may be of different types and sizes as further describe below with respect to FIGS. 6 and 7.

FIGS. 2A and 2B show example of a thermal storage blocks. FIG. 2A shows a foam with conductive fibers. FIG. 2B shows the foam block of FIG. 2A partially covered with a polymer encapsulant that is provided for heat absorption. In various embodiments, solid composite Thermal Energy Storage (TES) unit 200 includes a conductive base or substrate 202 and 204, and a solid thermal storage coating 206.

The use of solid modules of composite materials suitable for thermal storage at cryogenic temperatures offers some advantages over traditional refrigeration systems. There are materials that have good specific heat at cryogenic temperatures. Similarly, there are materials that have good thermal conductivity at cryogenic temperatures. These two thermal characteristics tend to be mutually exclusive. So, a material that has good conductivity may not have good thermal capacity and vice versa. Hence, the choice of a single material compromises either good thermal conductivity characteristics or good heat capacity characteristics. Since both of these characteristics are needed in a cooling system for the transfer of thermal energy and for thermal energy storage, a composite element composed of components each with one of these characteristics is highly desirable. Another desirable attribute of a thermal storage module is low volume, or in other words, high thermal capacity per unit of volume.

It is also desirable to use materials that do not result in generation of large amounts of asphyxiating gas, especially for applications in confined spaces. Thus, it is advantageous to use materials that are solid at room temperature, and therefore, don't go through phases changes during their application in cases that the cryogenic thermal storage reaches room temperature. Those skilled in the art will appreciate that material phase changes include changes from gas to liquid and from liquid to solid under various temperature and pressure conditions. During or after a phase change, some material such as helium and nitrogen, undergo significant pressure and volume changes and become difficult to handle. For example, during a phase transition from liquid to gas, the volume of nitrogen is multiplied hundreds of times necessitating the use of high pressure vessels to contain the pressure. Hence, having a solid thermal energy storage material that does not go through phase changes in the operating/working temperature ranges, is an advantage.

In various embodiments, composite material including a network of metal fibers encapsulated by selected polymers, potentially with filler, may be a suitable cryogenic thermal energy storage block that can increase the heat capacity of a cryogenic device with relatively small increase in its overall mass and volume, while also maintaining good thermal conductivity. Metal fibers are useful and effective for conducting heat between the block and the heat source. The encapsulating polymer is useful and effective for absorbing heat. The potential filler can be useful in terms of achieving improved thermal conductivity and/or mechanical performance for the polymer, as well as an effective path for relatively fast heat exchange between the polymer and the object to be cooled.

With continued reference to FIG. 1, in various embodiments, the TES unit 200 may be composed of a block of conductive foam 202 providing a network of thermally conductive fibers, and a solid high thermal capacity encapsulant at least partially covering the conductive base and providing heat absorption. In various embodiments, the TES unit 200 may include a bare metal section 204 of the substrate and a polymer encapsulated section 206. In various embodiments, the metal fibers may be primarily made of copper, aluminum, gold or silver plated metal fins, and any other metal with good conductivity. In various embodiments, the conductive fibers constituting the substrate may be arranged as parallel fins, finned arrays, sets of screens, loosely intertwined fiber strands, hollow honeycomb-like structures, hollow tubes, hollow profiles which increase heat exchange surface area, and other porous conductive structures. In various embodiments, the bare foam section 204, or other conductive substrate structures mentioned herein, may provide passage ways, channels, or porous inlets that allow flow of cryogenic gaseous refrigerant that can exchange heat with the polymer with good heat transfer characteristics, as further described below with respect to FIG. 3. Solid sections, like strips, of copper, aluminum, etc. may be added to strategic locations on the TES blocks to improve mechanical and thermal performance of TES blocks.

In various embodiments, the solid encapsulant with high thermal capacity may be a polymer that stays solid at room temperature. Examples of suitable polymers are polyethylene, polypropylene, general polymers with a formula $C_nH_{2n}$, and many one part or two part epoxies that are commonly used as encapsulants. Those skilled in the art will appreciate that other solid material may be used as encapsulants without departing from the spirit of the present disclosure. For example, the encapsulant may be made of silicon based foam or paste.

As described above, in various embodiments, an efficient cryogenic thermal storage element may be made as a composite a portion of which is high heat capacity polymer, and another portion of which is a heat conducting material that is dispersed within the polymer. In various embodiments, the encapsulant may have other solids included as filler. The filler materials may include metal powder, ceramic powder, chemical compound powder, and the like that help with heat conduction across polymer as well as cryogenic heat capacity. An example of metal powder is tin powder, and example of ceramic powder is $Al_2O_3$ powder, and example of chemical compound powder is $HoCu_2$ Those skilled in the art will appreciate that the thermal storage units may be solids of any shape and not just rectangular blocks. For example, the thermal storage units may be of any suitable size and shape. For example, such thermal storage units may have a circular shape, cylindrical shape, donut shape, strip shape, irregular shape, a combination thereof, and any other suitable shape for the application.

Figure 2:
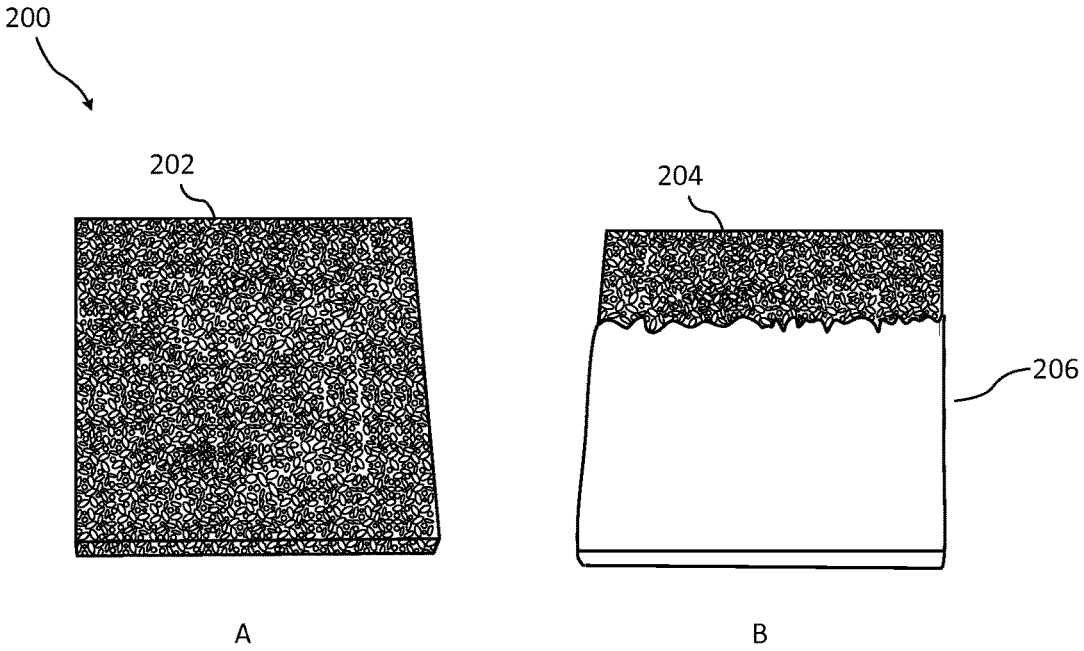
FIGS. 2A and 2B show example of a thermal storage blocks.
Figure 3:
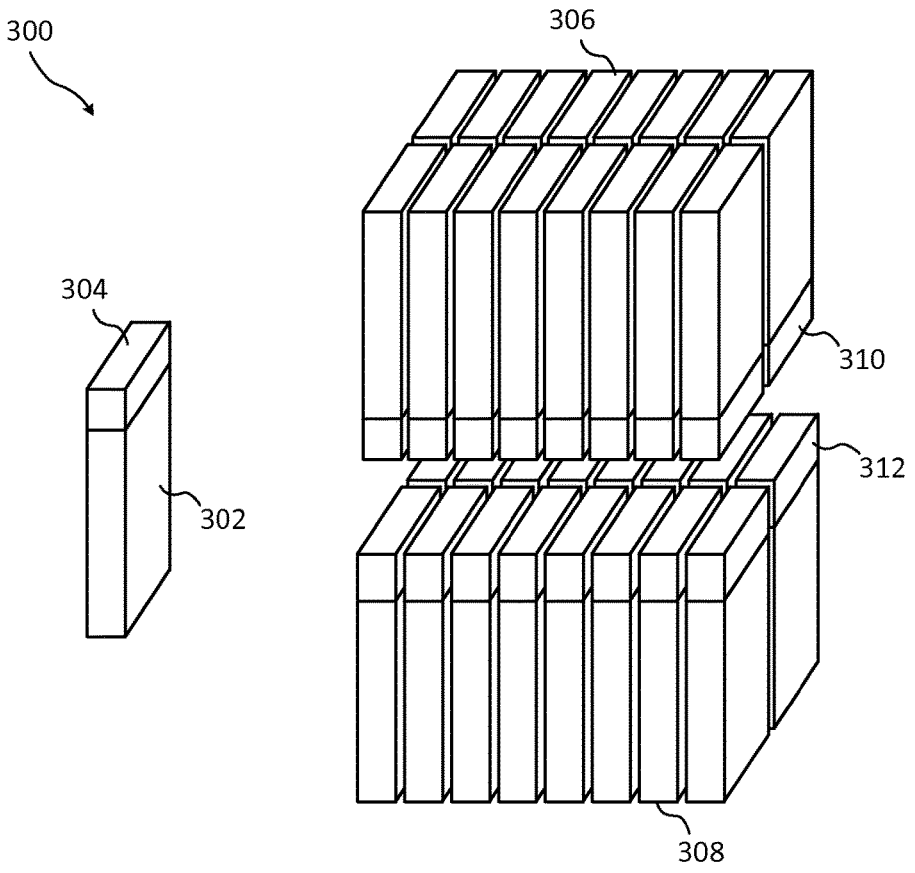
FIG. 3 shows an example arrangement of multiple thermal storage blocks of FIG. 2 combining small storage units to create a Thermal Energy Storage (TES) module with larger thermal capacity than the small storage units.

FIG. 3 shows an example arrangement of multiple thermal storage blocks of FIG. 2 combining small energy storage units to create a Thermal Energy Storage (TES) module with larger thermal capacity than the small storage units. In various embodiments, the TES module arrangement 300 includes an aggregation of thermal storage units 304 having a polymer-coated section 302 to form large modules 306 and 308 with conductive sections 310 and 312 not covered with or encapsulated by high heat capacity encapsulants.

With continued reference to FIG. 3, in various embodiments, multiple thermal storage units 304 may be attached, integrated, or otherwise assembled together to create larger TES modules 306 and 308, which in turn may be arranged to form even larger modules to form a larger cryogenic energy storage unit, as further described below with respect to FIGS. 4 and 5.

In various embodiments, with reference to FIG. 2, the thermal storage unit 200 may be constructed using more than one kind of polymer, each polymer with a potential filler, to accommodate a wider range of operations for the cryogenic device. In addition, a given cryogenic device may have multiple blocks, with various polymers as well as different conductive substrate based on type of material, pore density, and/or mass density of the substrate. This way, the performance characteristics of the cryogenic thermal storage elements may be adjusted for a given temperature of operation. For example, higher thermal capacity storage units may be used when more heat is generated by the cryogenic device, while lower capacity thermal storage units, which may also be smaller in size and cost, may be used when less thermal capacity is needed, such as during idle times.

In various embodiments, heat transfer elements such as refrigerant ducts or pipes, or cryogenic components such as current leads may be interfaced with the TES modules between sections 310 and 312 to optimize heat transfer to the thermal storage and reduce the temperature rise of the current lead. For example, the cryogenic thermal storage units and/or modules may be useful when they are integrated with current leads that connect the current terminals of a superconducting magnet in a MRI machine from the room temperature part of the magnet system to its cryogenic part. In this type of application the cryogenic thermal storage block (TES unit) help absorb the electrical resistive heat that the current leads generate and that is conducted along the current lead.

Figure 4:
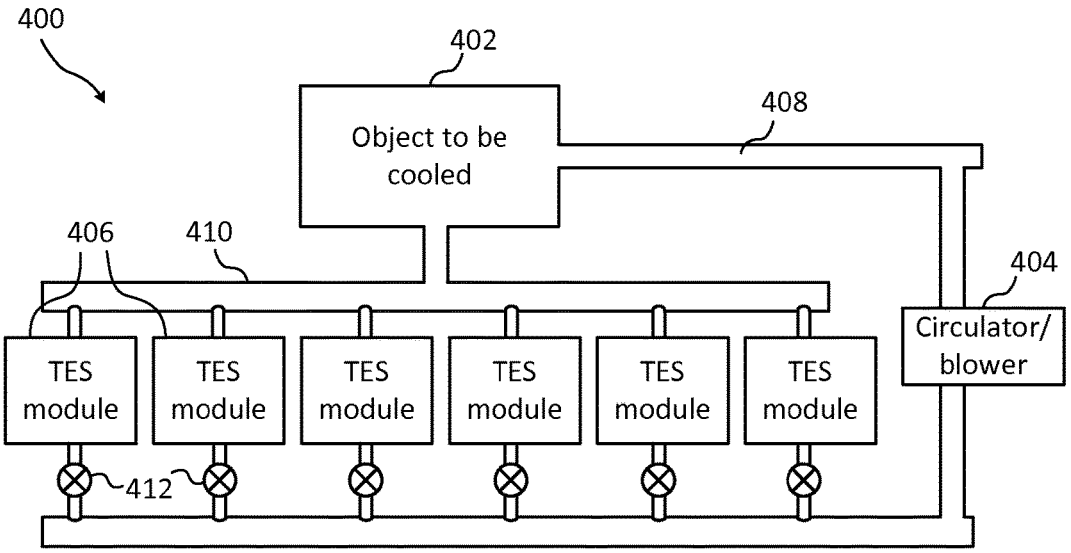
FIG. 4 shows an example cryogenic cooling system employing multiple TES modules to cool the same cryostat.

FIG. 4 shows an example cryogenic cooling system employing multiple TES modules to cool the same cryostat. In various embodiments, cooling system 400 includes cryostat 402 containing the cryogenic device to be cooled, refrigerant duct or pipe 408, refrigerant circulator/blower 404, flow control valves 412, TES modules 406, and refrigerant return pipes 410.

In various embodiments, cryocoolers (shown in FIGS. 1, 6 and 7) may be used as the active or main cooling system to cool the cold-mass and/or TES. The TES modules provide additional thermal storage capacity to keep the cryostat and the contained cryogenic device (cold-mass) cool during transient operation and/or a failure of the active cooling system. The TES modules also serve to avoid large and fast temperature swings by keeping the thermal environment relatively stable by absorbing large amounts of thermal energy.

In various embodiments, the cooling system 400 forms an interconnected network of three main cooling components: TES modules, cooling devices such as cryocoolers (not shown in this figure), and control valves. By controlling the valves, the flow of heat between the cryostat, the TES modules, and the cryocoolers is controlled. Also, by keeping particular valves open and other particular valves closed, this interconnected network may be reconfigured. For example, by closing a control valve between the refrigerant pipe 408 and a selected TES module, the flow of refrigerant may be controlled to other TES modules. Such arrangement may be useful in cases where the selected TES module has a lower thermal capacity than needed at the time, while other TES modules not so blocked in the path of the refrigerant may have higher thermal capacity as needed. Another example of reconfiguration is when a particular TES module needs to be isolated and repaired or replaced.

In the cooling system 400, in various embodiments, multiple TES modules may be assembled within the same cryostat, but within different container, with control valves to direct the flow of coolant to the appropriate TES module (s). While in other embodiments, multiple TES modules may be placed within a single cryostat and container to simplify the arrangement. Similarly, multiple cryostats may be served by the same cooling system. For example, in a hospital or clinic with multiple MRI machines, each forming its own cryostat, a single large cooling system may be coupled with all of the cryostats. In such configuration, a particular cryostat may be coupled with a particular one or bank of TES modules via control valves for steady-state or transient cooling as needed. This way, cost, space requirements, and maintenance requirements of the cooling system and cryogenic systems may be reduced significantly.

Figure 5A:
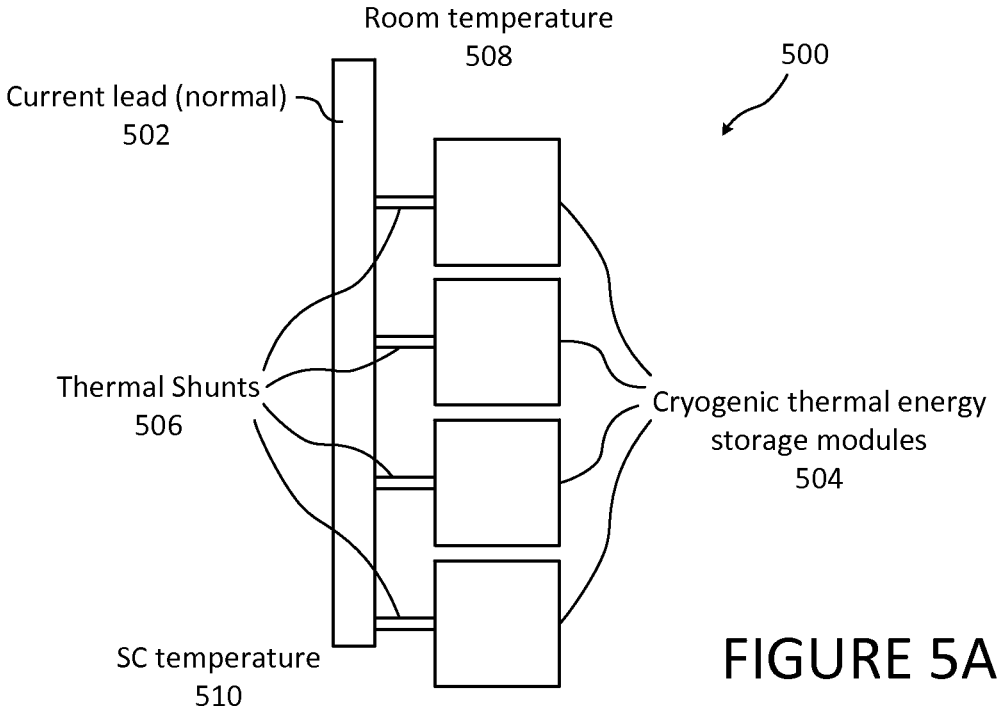
FIG. 5A shows an example of a non-superconducting current lead cooled with multiple cryogenic TES modules of FIG. 2.

FIG. 5A shows an example of a non-superconducting current lead cooled with multiple cryogenic TES modules of FIG. 2. In various embodiments, cooling arrangement 500 includes a non-superconducting or normal electrical current lead 502 connected via thermal shunts 506 to TES modules 504, the current lead spanning from room temperature 508 to super conducting or cryogenic temperatures 510.

In various embodiments, the thermal shunts are thermally conducting elements coupled with the current lead and the TES modules to cool the current lead. Moving from room temperature 508 region to the cryogenic temperature 510 region, the corresponding TES modules may have successively lower temperatures. The TES modules are in turn cooled by cryocoolers as further described below with respect to FIGS. 6 and 7. In various embodiments, the temperatures of the different TES modules, during steady-state operation, are substantially the same as the particular segments of current lead. However, if there is a failure in the cryogenic cooling devices, or if extra heat is generated in the environment, or by the cryogenic devices, then the TES modules may absorb more thermal energy, limiting the cooling of the current lead. Such cases may happen during a transient operation when more heat needs to be absorbed by the TES modules.

In various embodiments, it is possible to use the same main coolant or refrigerant to chill the TES modules. In this case, the temperature of the system may increase if the active cooling system using the cryocoolers fails and the cryogenic TES modules are engaged. In this case, the system will continue to perform until the temperature rises and the temperature margin of the superconductor/cryogenic device is exhausted.

Figure 5B:
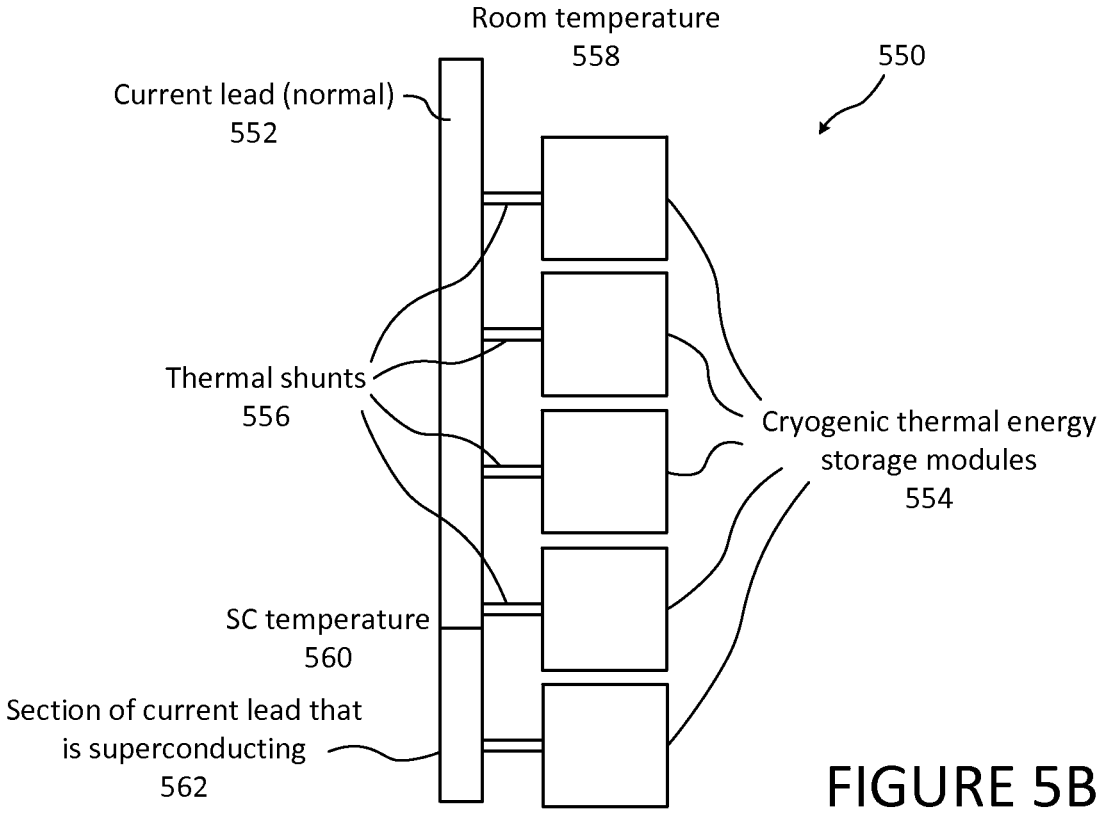
FIG. 5B shows an example of a current lead including non-superconducting and superconducting conductors cooled with multiple cryogenic TES modules of FIG. 2.

FIG. 5B shows an example of a current lead including non-superconducting and superconducting conductors cooled with multiple cryogenic TES modules of FIG. 2. In various embodiments, cooling arrangement 550 includes a non-superconducting or normal electrical current lead 552 and a superconducting electrical current lead 562 each connected via thermal shunts 556 to TES modules 554, the current leads spanning from room temperature 558 to super conducting or cryogenic temperatures 560. In various embodiments, the operation of this configuration is substantially similar to the operation of the configuration described above with respect to FIG. 5A.

Figure 6:
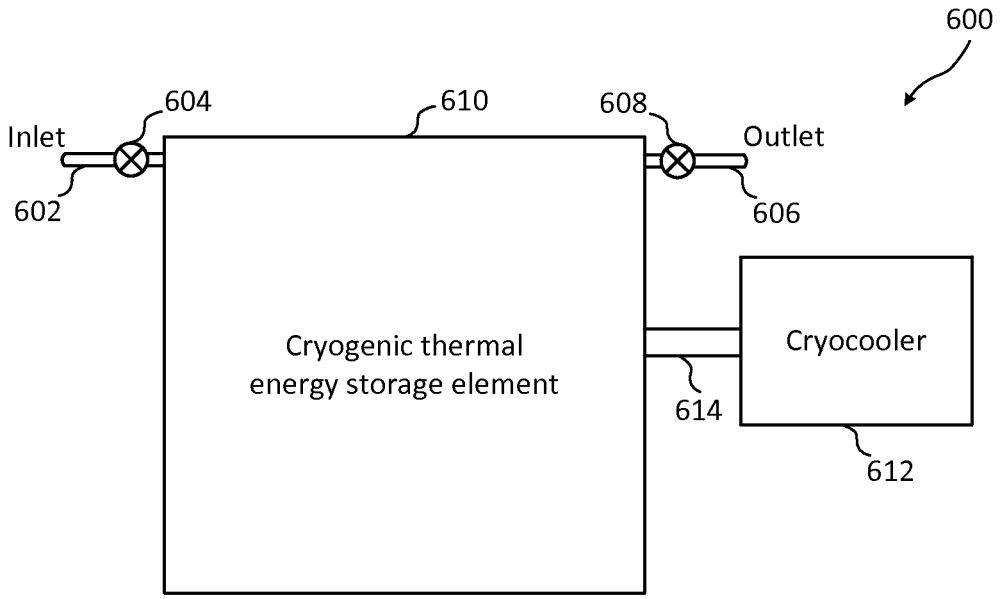
FIG. 6 shows an example of a compact chiller including a cryocooler coupled with a TES module.

FIG. 6 shows an example a compact chiller including a cryocooler coupled with a TES module. In various embodiments, active cooling system 600 includes inlet refrigerant pipe 602, inlet flow control valve 604, TES module 610, outlet flow control valve 608, outlet refrigerant pipe 606, thermal shunt 614 coupled between the TES module 610 and cryocooler 612.

In various embodiments, TES module 610 cools the refrigerant flowing in refrigerant pipes, in turn cooling the cold-mass within the cryostat, and the TES module itself is cooled by the cryocooler 612. The total cooling capacity of the cooling system is, thus, the sum of the thermal capacity of the TES modules and the cooling capacity of the cryocooler. The TES modules' cooling capacity is fixed by their type and design, while the cooling capacity of the active cryocooler 612 is increasing and additive over time, but at a fixed rate. That is, in the absence of the cryocooler, a constant and fixed amount of generated thermal energy can be absorbed by the TES modules. But the cryocooler has a steadily continuing capacity to cool over time at a fixed rate of cooling, for example W (watt)

In various embodiments, the valves 604 and 608 may be used to configure and reconfigure a network of such TES modules and cryocoolers in a large cooling system as described above with respect to FIG. 4. The reconfiguration and cooling resource reassignment may be generally done by opening and closing flow control valves for the refrigerant pipes. The cryocoolers may also be coupled by thermal shunts to multiple TES modules. The Shunts may also include thermal conductivity switches, further described below, to thermally isolate the corresponding cryocooler from the TES module. This way, the connections between the TES modules and the cryocoolers may also be reconfigured.

In various embodiments, a compact chiller or cryocooler, such as a compact Stirling cryocooler may be employed for steady-state cooling. The cooling capacity of the cryocooler needs to be at least as much as the steady-state cooling needs. In operation, the TES module 610 is cooled by the dedicated cryocooler coupled with the TES module, and maintained at this temperature by the cryocooler. The temperature of the TES modules needs to be lower than that of the cryogenic device that is being cooled. In this manner, it is possible to absorb a limited amount of energy in the TES module without raising the temperature of the cryogenic device. The TES system can be engaged by the use of valves or other types of systems, such as thermal conductivity switch. The thermal conductivity switch may be implemented using any one of a variety of techniques that can substantially thermally isolate one side of a thermal interface from the other, by using some sort of thermal insulation. For example, a vacuum chamber or other insulating material may be used to cause thermal isolation between two heat exchanging bodies.

In various embodiments, cryocooler may be implemented using any refrigeration technique that can provide cryogenic temperatures, typically below 150 K. ThermoElectric Coolers (TEC) may be used as part of the refrigeration system. TECs, also known as Peltier coolers, are solid-state heat pumps that operate based on the Peltier effect to move heat and can create a differential temperature of up to 70° centigrade or more. The temperatures reached by a refrigeration system depend largely on material such as the refrigeration gas used, solid state junctions in TECs, and the like. Other cryogenic refrigeration systems include Gifford-Mac Mahan type systems and pulse tubes.

In various embodiments, Superconducting magnets that utilize low temperature superconductors, for example Nb—Ti and $Nb_3Sn$, operate at very low temperatures of 3-16 K. One method of cooling down such a superconducting magnet to these very low temperatures is by using a two-stage cryocooler (also known as a cryo-refrigerator) that makes physical contact with designated parts of the magnet system thereby extracting heat by way of conduction through the connected parts. This method of cooling is commonly referred to as being Cryogen Free (CF), or conduction cooling. The two-stage cryocooler is still a single cryocooler with two internal stages.

The amount of cooling (removal of heat) that is provided by a two stage cryocooler can be a few tens of watts for the first stage achieving for example a temperature of 30-60K and a few watts for the second stage achieving 3-6K. Therefore the amount of heat transferred (also known as heat leak) to the superconducting magnet from the environment must be reduced to or be lower than the cooling capacity of the cryocooler.

Figure 7:
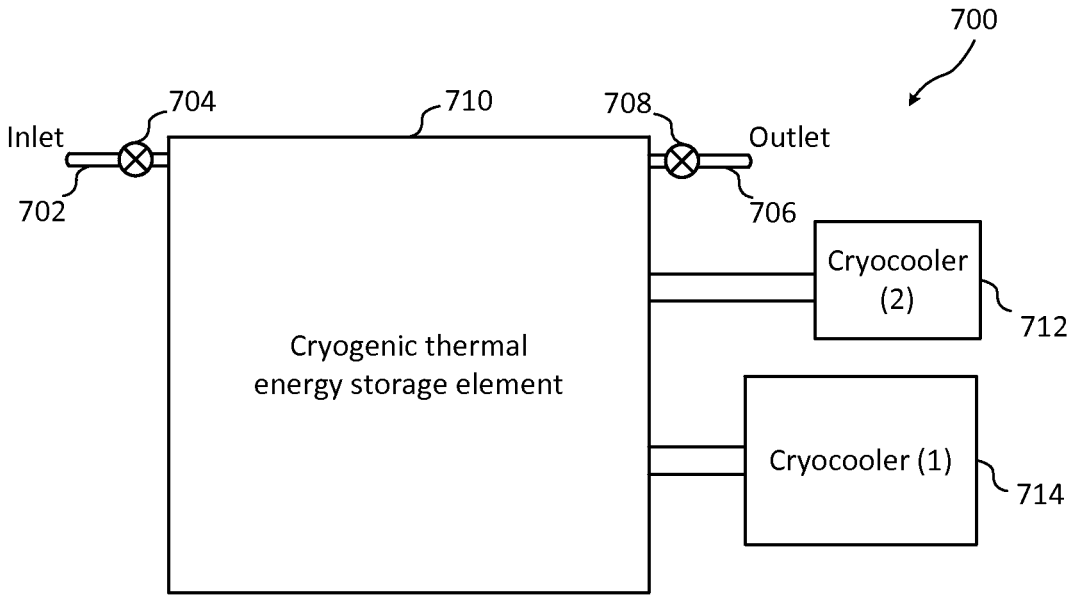
FIG. 7 shows an example chiller including a TES module coupled with two differently sized cryocooler configured for steady state and transient cooling of the TES, respectively.

FIG. 7 shows an example cryogenic cooling system including a TES module coupled with two differently sized cryocooler configured for steady state and transient cooling of the TES, respectively. In various embodiments, active cooling system 700 includes inlet refrigerant pipe 702, inlet flow control valve 704, TES module 710, outlet flow control valve 708, outlet refrigerant pipe 706, thermal shunts coupled between the TES module 710 and a small capacity cryocooler 712 and a large capacity cryocooler 714.

In various embodiments, for certain cryogenic heat exchanger application the heat exchanger unit (cooling system) may operate with two differently thermally sized cryocoolers as shown in FIG. 7. In operation, initially, or after a transient condition where significant heat has been transferred to the TES module, the TES module is cooled to its target cryogenic temperature from room temperature by the larger cryocooler 714. The target cryogenic temperature is then maintained by the smaller cryocooler 712. In steady state conditions where the system is being maintained at the target steady state temperature by the smaller cryocooler, the larger cryocooler may be turned off or placed in a standby mode.

In various embodiments, cryogenic energy storage may also be very useful in a different application than cooling cryogenic devices, namely, it may be useful for the quick liquefaction of natural gas. Room temperature natural gas can be introduced into the thermal storage, for quick liquefaction without the need of on-site LNG (Liquefied Natural Gas) storage. In various embodiments, instead of cooling the natural gas and storing it, the energy storage is pre-cooled and placed in idle mode, with on-demand production of LNG, for example, to refuel a vehicle. Because of the desired large production rate of LNG, energy storage with fast thermal time constants is desired, in a system that can tolerate substantial thermal gradients. Either modular units with flow control valves, or TES units placed in series, can be used for optimally using the energy produced. Multiple units at different temperatures can also be used. Higher temperature units may be useful for removing contaminants in the natural gas, such as water and CO2. These high temperature elements may be regenerated by heating after the transfer operation, in order to evaporate the ice or the frozen $CO_2$. The elements are recooled by either reverse flow of a coolant (such as nitrogen or even air), or by a refrigerator.

Changes can be made to the claimed invention in light of the above Detailed Description. While the above description details certain embodiments of the invention and describes the best mode contemplated, no matter how detailed the above appears in text, the claimed invention can be practiced in many ways. Details of the system may vary considerably in its implementation details, while still being encompassed by the claimed invention disclosed herein.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the claimed invention to the specific embodiments disclosed in the specification, unless the above Detailed Description section explicitly defines such terms. Accordingly, the actual scope of the claimed invention encompasses not only the disclosed embodiments, but also all equivalent ways of practicing or implementing the claimed invention.

The above specification, examples, and data provide a complete description of the manufacture and use of the composition of the invention. Since many embodiments of the invention can be made without departing from the spirit and scope of the invention, the invention resides in the claims hereinafter appended. It is further understood that this disclosure is not limited to the disclosed embodiments, but is intended to cover various arrangements included within the spirit and scope of the broadest interpretation so as to encompass all such modifications and equivalent arrangements.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

While the present disclosure has been described in connection with what is considered the most practical and preferred embodiment, it is understood that this disclosure is not limited to the disclosed embodiments, but is intended to cover various arrangements included within the spirit and scope of the broadest interpretation so as to encompass all such modifications and equivalent arrangements.

What is claimed is:

1. A Thermal Energy Storage (TES) unit comprising:

a solid conductive substrate structure made of a first material configured to conduct heat at cryogenic temperatures; and a solid thermal storage element made of a second material coupled with the conductive substrate configured to absorb thermal energy at cryogenic temperatures conducted in by the conductive substrate, wherein the thermal storage element remains solid at room temperature, and wherein the solid thermal storage element does not undergo material phase-change at any point in an operation of the TES and wherein the heat conductivity of the first material is higher than the heat conductivity of the second material and the heat capacity of the second material is higher than the heat capacity of the first material.

2. The TES unit of claim 1, further comprising a passage ways within the conductive substrate configured to allow the passage of gaseous material through the conductive substrate to reach and come in contact with the solid thermal storage element.

3. The TES unit of claim 1, further configured to be coupled with a cryocooler to remove heat from the TES unit.

4. The TES unit of claim 1, wherein the TES is coupled with a cryocooler configured to operate in a steady state mode.

5. The TES unit of claim 1, wherein the TES is coupled with a cryocooler configured to operate in a transient mode.

6. The TES unit of claim 1, wherein the TES is coupled with additional TES units, all TES units being coupled with a cryocooler via channels and valves to form a network of TES units.

7. The TES unit of claim 1, wherein the TES is coupled with a second TES unit, and wherein the second TES unit has a different heat capacity than the TES unit.

8. The TES unit of claim 1, wherein the TES is coupled with additional TES units, all TES units being coupled with a cryocooler via channels and valves to form a network of TES units, and wherein the network of TES units is configurable by opening and closing different valves.

9. A cooling system comprising:

a Thermal Energy Storage (TES) unit having a solid conductive substrate structure, made of a first material, and a solid thermal storage element, made of a second material, coupled with the conductive substrate operating at cryogenic temperatures, wherein the thermal storage element remains solid at room temperature, and wherein the solid thermal storage element does not undergo material phase-change at any point in an operation of the TES and wherein the heat conductivity of the first material is higher than the heat conductivity of the second material and the heat capacity of the second material is higher than the heat capacity of the first material; and a refrigerant channel coupled with the TES unit via a flow control valve, wherein the flow control valve is usable to reconfigure a coupling of the TES unit to the refrigerant channel.

10. The cooling system of claim 9, further comprising an active cooler coupled with the TES unit to cool down the TES unit.

11. The cooling system of claim 9, further comprising additional TES units, additional refrigerant channels and additional valves, all together forming a cooling network comprising a plurality of TES units, valves, and refrigerants coupled with one or more active coolers.

12. The cooling system of claim 11, wherein the cooling network is dynamically reconfigured using the valves to connect different TES units to different channels and active coolers.

13. The cooling system of claim 11, wherein some of the TES units have different cooling capacities from some of the other TES units.

14. The cooling system of claim 9, further comprising an active cooler coupled with the TES unit, wherein the active cooler is configured to operate in a steady state mode or a transient mode.

15. A method of cooling, the method comprising:

using a Thermal Energy Storage (TES) unit to store heat carried away from a cryostat, wherein the TES unit comprises a solid conductive substrate structure made of a first material and a solid thermal storage element, made of a second material, coupled with the conductive substrate operating at cryogenic temperatures, wherein the thermal storage element remains solid at room temperature, and wherein the solid thermal storage element does not undergo material phase-change at any point in an operation of the TES and wherein the heat conductivity of the first material is higher than the heat conductivity of the second material and the heat capacity of the second material is higher than the heat capacity of the first material; and cooling down the TES with an active cooling apparatus when a predetermined threshold temperature is reached.

16. The method of claim 15, further using flow control valves to direct a flow of a refrigerant fluid to the TES unit.

17. The method of claim 15, further coupling additional TES units with the TES unit via a refrigerant channel.

18. The method of claim 15, wherein active cooling apparatus is a cryocooler and is configured to operate in a steady state or a transient mode.

19. The method of claim 15, wherein the TES unit includes passage ways to allow flow of fluid refrigerant through the TES.

20. The method of claim 15, further comprising dynamically reconfiguring additional TES units, additional channels and additional active cooling apparatuses via additional valves.

* * * * *